US011685033B2

(12) United States Patent
Williams

(10) Patent No.: US 11,685,033 B2
(45) Date of Patent: Jun. 27, 2023

(54) SHIPBOARD MULTI-TOOL

(71) Applicant: Thomas Williams, San Clemente, CA (US)

(72) Inventor: Thomas Williams, San Clemente, CA (US)

( * ) Notice: Subject to any disclaimer, the term of this patent is extended or adjusted under 35 U.S.C. 154(b) by 52 days.

(21) Appl. No.: 16/925,156

(22) Filed: Jul. 9, 2020

(65) Prior Publication Data

US 2021/0023687 A1 Jan. 28, 2021

Related U.S. Application Data

(63) Continuation-in-part of application No. 29/689,619, filed on Apr. 30, 2019.

(60) Provisional application No. 62/872,123, filed on Jul. 9, 2019.

(51) Int. Cl.
*B25F 1/00* (2006.01)
*B25B 13/02* (2006.01)
*B25B 13/56* (2006.01)

(52) U.S. Cl.
CPC ..... *B25F 1/003* (2013.01); *B25B 13/02* (2013.01); *B25B 13/56* (2013.01)

(58) Field of Classification Search
CPC ..... B25F 1/003; B25B 13/02; B25B 13/56
USPC ..... 81/440; 7/138, 118
See application file for complete search history.

(56) References Cited

U.S. PATENT DOCUMENTS 6,182,541 B1 * 2/2001 Anderson ..... B25G 1/043 81/439
6,868,760 B1 * 3/2005 Johnson ..... B25B 13/56 81/439
7,146,889 B2 * 12/2006 Kang ..... B25F 1/04 81/437
8,490,523 B2 * 7/2013 Tsai ..... B25F 1/04 81/439
9,457,460 B2 * 10/2016 Hermansen ..... B25H 3/003

* cited by examiner

*Primary Examiner* — Hadi Shakeri
(74) *Attorney, Agent, or Firm* — Myers Andras Ashman Bisol LLP; Joseph C. Andras

(57) ABSTRACT

A Shipboard Multi-tool. The Multi-tool includes a pair of groups of tools that are individually-extendable from the handle in order to allow the Multi-tool to operate a plurality of different shipboard mechanisms with a single assembly. One group of extendable tools includes spanner and box wrenches. Another group of extendable tools includes key-type wrenches. The individual extendable wrenches are lockable in a variety of angular positions relative to the handle to provide the user with several configurations with which to use the wrenches. The locking mechanisms are operable by depressing a spring-loaded push-button.

15 Claims, 8 Drawing Sheets

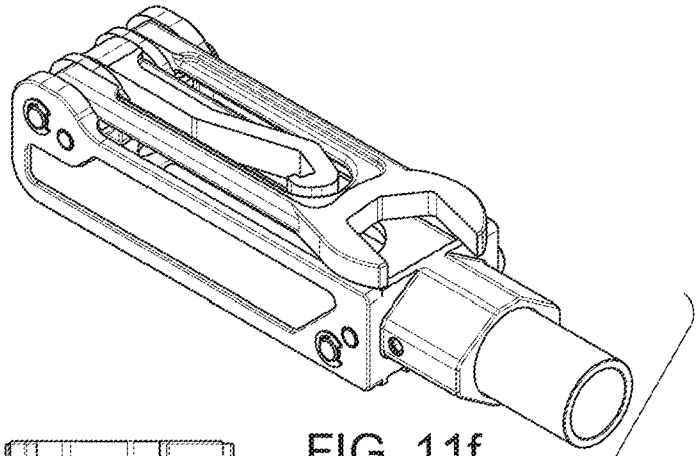
FIG. 11f
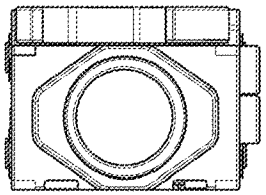
FIG. 11c
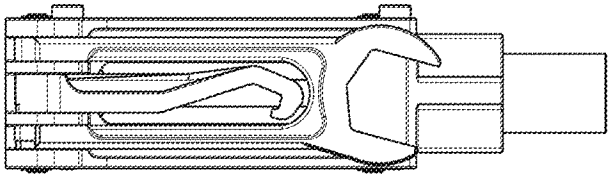
FIG. 11e
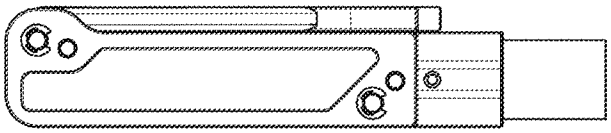
FIG. 11b
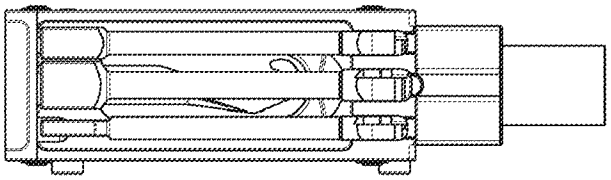
FIG. 11d
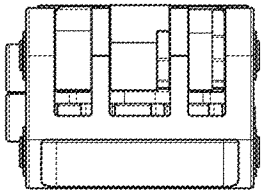
FIG. 11a
10a
FIG. 11

SHIPBOARD MULTI-TOOL

This application is filed within one year of, and claims priority to Provisional Application Ser. No. 62/872,123, filed Jul. 9, 2019.

This application is a continuation-in-part of application Ser. No. 29/689,619, filed Apr. 30, 2019, now pending.

BACKGROUND OF THE INVENTION

1. Field of the Invention

This invention relates generally to tools and fixtures and, more specifically, to a Shipboard Multi-tool.

2. Description of Related Art

Large ocean-going vessels are a complex maze of piping, fittings, watertight closures and hatches. In addition to these components providing the infrastructure to the numerous operational systems aboard the ship, they have another important purpose—watertight integrity. In particular, during drills, repairs or actual onboard emergencies, shipboard personnel frequently are required to operate valves, secure ("dog down") hatches and doors, attach and detach firehoses at virtually all locations throughout the ship. In order to operate many of these components, the Damage Controlmen and other shipboard personnel will require a specialized wrench or tool.

Historically, operators have kept the proper specialized tool staged in pre-set locations throughout the ship so that the tools are conveniently at hand in the event of an urgent need for them. There are two problems with this approach—first, the high number of individual compartments (i.e. rooms) aboard a ship prevents there being a full set of tools in each compartment. As a result, most of the time, the technician must still leave the immediate area in order to get the proper tool. Second, because it is not feasible to lock all of the distributed storage cabinets, it is common that the storage cabinet tool inventories are not complete—either due to pilferage, wear, losses or failure to return the tools to their proper storage location. While it would be much more convenient for Damage Controlmen and other personnel operating these mechanical systems to have a full set of tools with them at all times, the sheer size and number of these tools has made it too bulky and inconvenient to be possible. What is needed is a single multi-function tool that can be conveniently carried at all times so that it is always available on a moments notice.

SUMMARY OF THE INVENTION

In light of the aforementioned problems associated with the prior devices and systems, it is an object of the present invention to provide a Shipboard Multi-tool. The Multi-tool should have a pair of groups of tools that are individually-extendable from the handle in order to allow the Multi-tool to operate a plurality of different shipboard mechanisms with a single assembly. One group of extendable tools should include spanner and box wrenches. Another group of extendable tools should include key-type wrenches. The individual extendable wrenches should be lockable in a variety of angular positions relative to the handle to provide the user with several configurations with which to use the wrenches. The locking mechanisms should be operable by depressing a spring-loaded push-button.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

FIG. 11 are a plurality of views of the tool of FIG. 10.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Shipboard Multi-tool.

Figure 1:
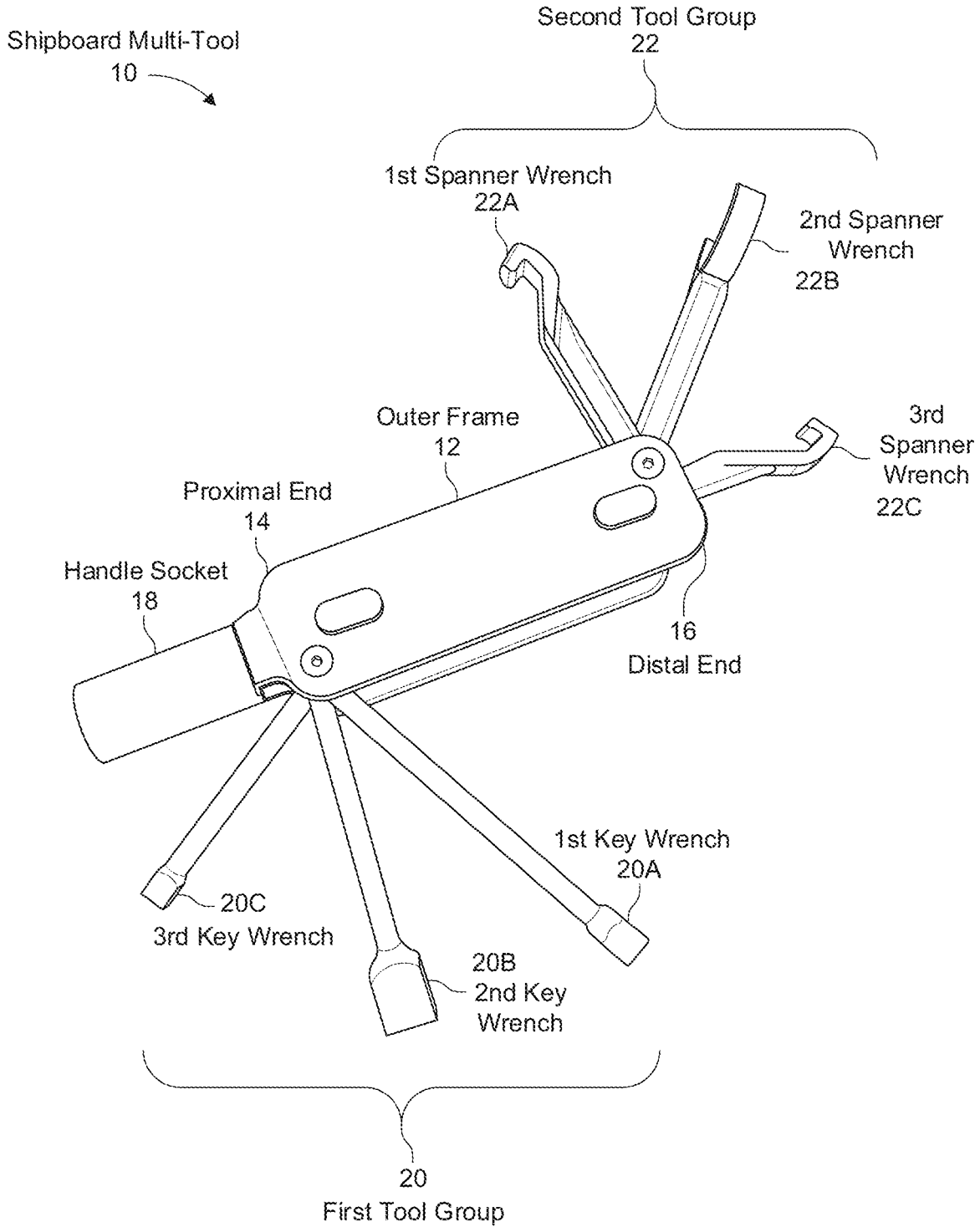
FIG. 1 is a side view of a preferred embodiment of the shipboard multi-tool of the present invention.

The present invention can best be understood by initial consideration of FIG. 1.[1] FIG. 1 is a side view of a preferred embodiment of the shipboard multi-tool 10 of the present invention. The multi-tool 10 is a series of specialized implements combined into a single condensed and convenient package. The implements are housed within the outer frame 12, which is defined by a proximal end 14 and a distal end 16. A cylindrical (or other appropriately shaped) handle socket 18 extends from the proximal end 14.

[1]As used throughout this disclosure, element numbers enclosed in square brackets [ ] indicates that the referenced element is not shown in the instant drawing figure, but rather is displayed elsewhere in another drawing figure.

A first tool group 20 is extendable from the proximal end 14 of the outer frame 12. The preferred tools that comprise this first group 20 are a first key wrench 20A (a medium-sized square head), a second key wrench 20B (a large-sized square head), and a third key wrench 20C (a small-sized square head). These square headed wrenches are intended to operate deck drains (the small-sized square head 20C) as well as remote valve operators (20A and 20B) and quick-acting water-tight scuttles (medium-sized wrench 20A). The tools of the first tool group 20 are all of the type that are suitable to be used with the tool extending at a 90 degree angle to the outer frame 12 (i.e. using the frame 12 and socket 18 as a T-wrench relative to the extended tool of the group 20). Generally, only a single tool in the group 20 would be in use at a time. The tool socket 18 has another purpose as well—it can be used to provide additional leverage when operating "dogs" on watertight hatches by slipping the socket 18 over the dog to tighten or loosen the dog.

A second tool group 22 is extendable from the distal end 16 of the outer frame 12. The group 22 is preferably comprised of a first spanner wrench 22A (a large-sized spanner wrench), a second spanner wrench 22B (a large box wrench), and a third spanner wrench 22C (a small-sized spanner wrench). The wrenches in this group 22 are located at the distal end 16 of the frame 12 so that they are not confined to only being used in the T-shaped configuration of the tools in the first group 20. If we now turn to FIG. 2, we can continue to examine the features of this novel device.

Figure 2:
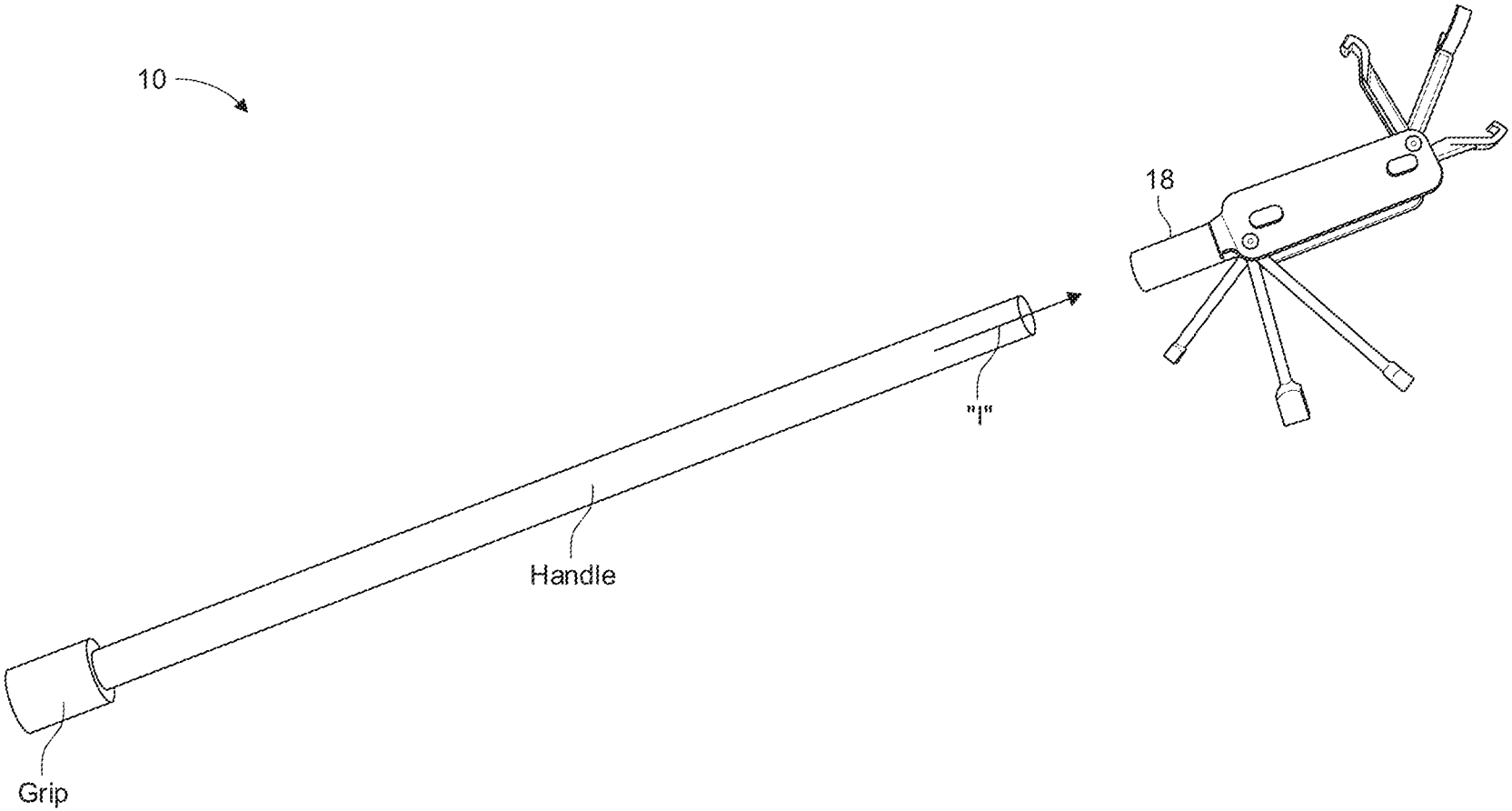
FIG. 2 is an exploded side view of the tool of FIG. 1.

FIG. 2 is an exploded side view of the tool 10 of FIG. 1. In some circumstances, additional leverage is necessary in order to operate a particular valve or closure. The tool 10 was designed to allow the user to attach an elongate handle 23 to it to provide this leverage. The handle 23 is preferably a length of tubular material and may have a non-slip grip 25 at its distal end. The proximal end inserts into (or onto) the handle socket 18. It is expected that the handle 23 will not usually be carried by the technician, but rather obtained onsite when necessary. It should be understood that the handle socket 18 is sized so that conventional handles (e.g. broom handles) would be used inserted into the socket 18, if necessary.

Figure 3:
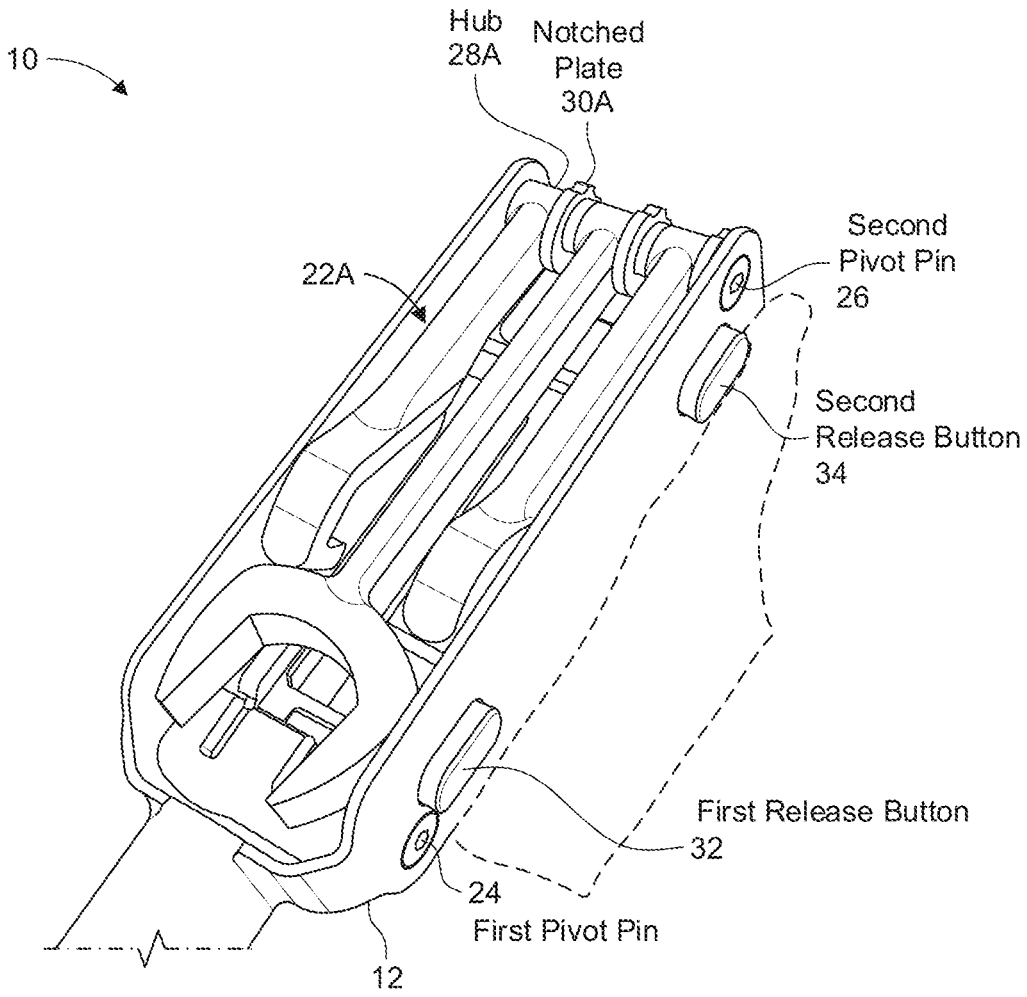
FIG. 3 is a top perspective view of the tool of FIG. 1.

FIG. 3 is a top perspective view of the tool 10 of FIG. 1. Here, we can see the second tool group 22 in their retracted (or housed) position. The tools 22A-22C are mounted to the frame 12 by second pivot pin 26. Each tool (e.g. 22A) has a hub 28A through which the pivot pin 26 passes. Each hub (e.g. 28A) has a notched plate (e.g. 30A) attached or incorporated into it. The plates (e.g. 30A) have a series of notches formed around their periphery. These notches cooperate with an internal mechanism that will hold the wrench (e.g. 22A) in a particular radial position relative to the frame 12. The notches are engaged and released by depressing the second release button 34. The first pivot pin 24 and first release button 32 (for pivoting the wrenches of the first tool group) are located at the proximal end of the outer frame 12.

Figure 4:
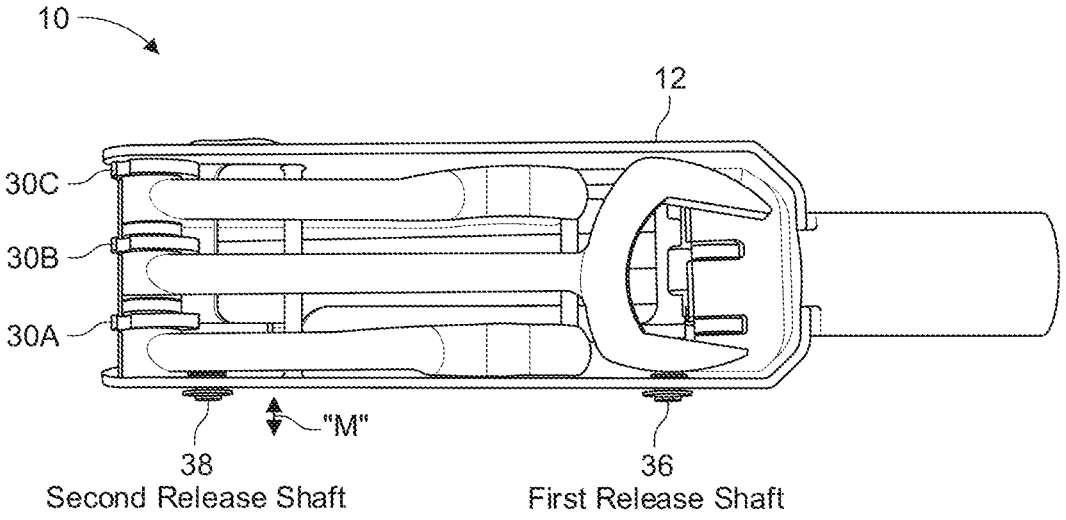
FIG. 4 is a top view of the tool of FIG. 1.

FIG. 4 is a top view of the tool 10 of FIG. 1. The notches formed in the notched plates 30A, 30B, 30C are engaged and disengaged from second release shaft 38 by pressing and releasing the second release button 34. In order to release the notches from the shaft 38, the technician depresses the release button 34 so that the shaft 38 moves in direction "M" (downward in this view). Releasing the button 34 will cause the shaft 38 to move back up—thereby engaging whichever notch is aligned with the shaft 38. This mechanism serves to hold the wrenches in the groups 20, 22 in the stowed position (as shown here), or in individually-extended positions.

Figure 5:
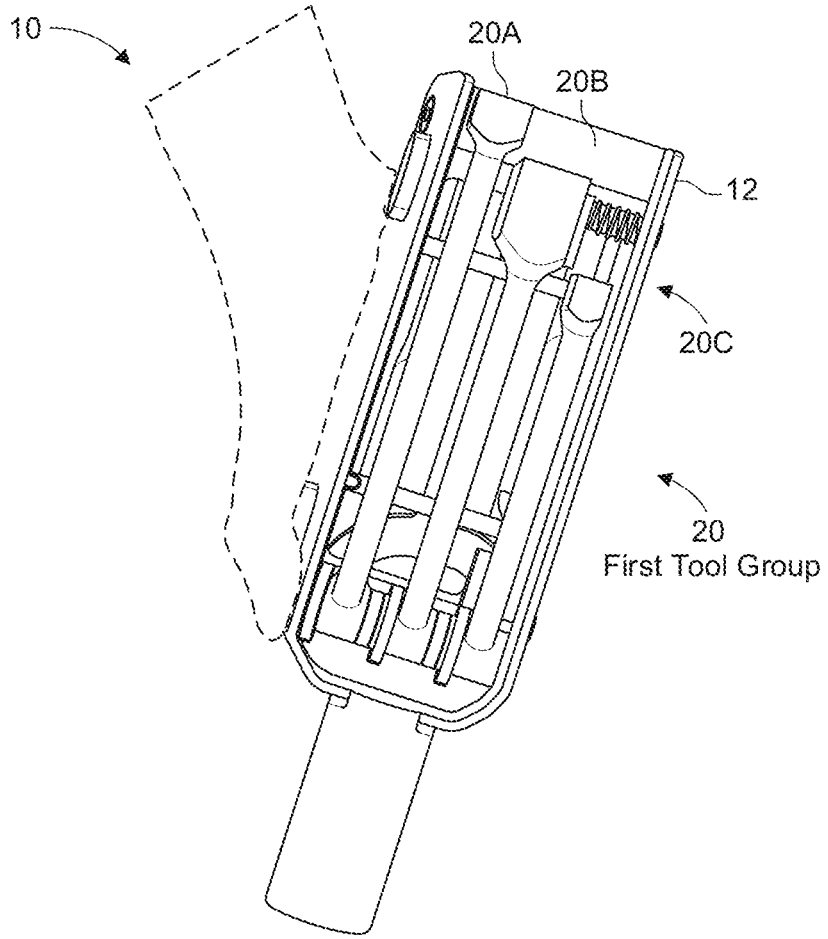
FIG. 5 is a bottom perspective view of the tool of FIG. 1.
Figure 6:
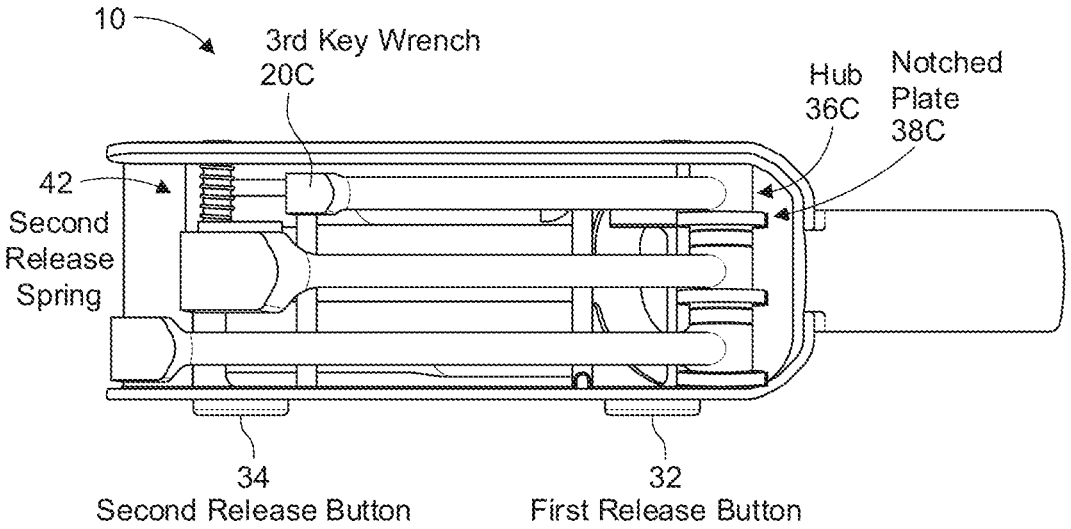
FIG. 6 is a bottom view of the tool of FIG. 6.

FIGS. 5 and 6 are bottom perspective and bottom views, respectively, of the tool 10 of FIG. 1. Here, we can see that the individual key wrenches 20A, 20B, 20C stow neatly within the outer frame 12. One other feature that can be seen here is the second release spring 42 along the second release shaft. The release spring 42 biases the second release shaft 38 down (in this view) such that depressing the second release button 34 will cause the spring 42 to be compressed (as the shaft 38 moves up).

Figure 7:
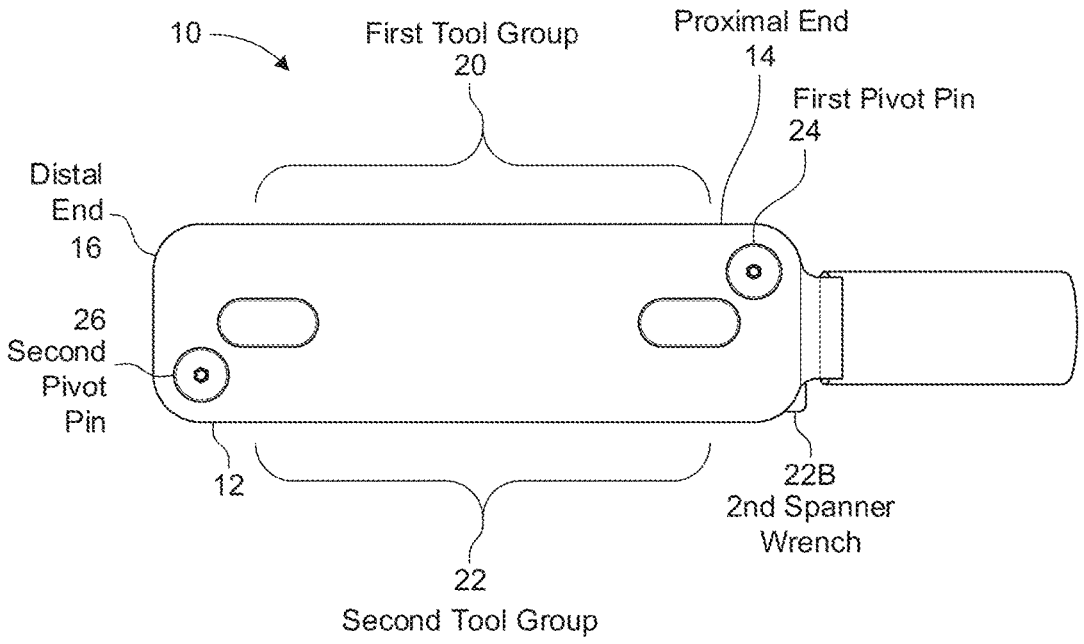
FIG. 7 is a side view of the tool of FIG. 7.
Figure 8:
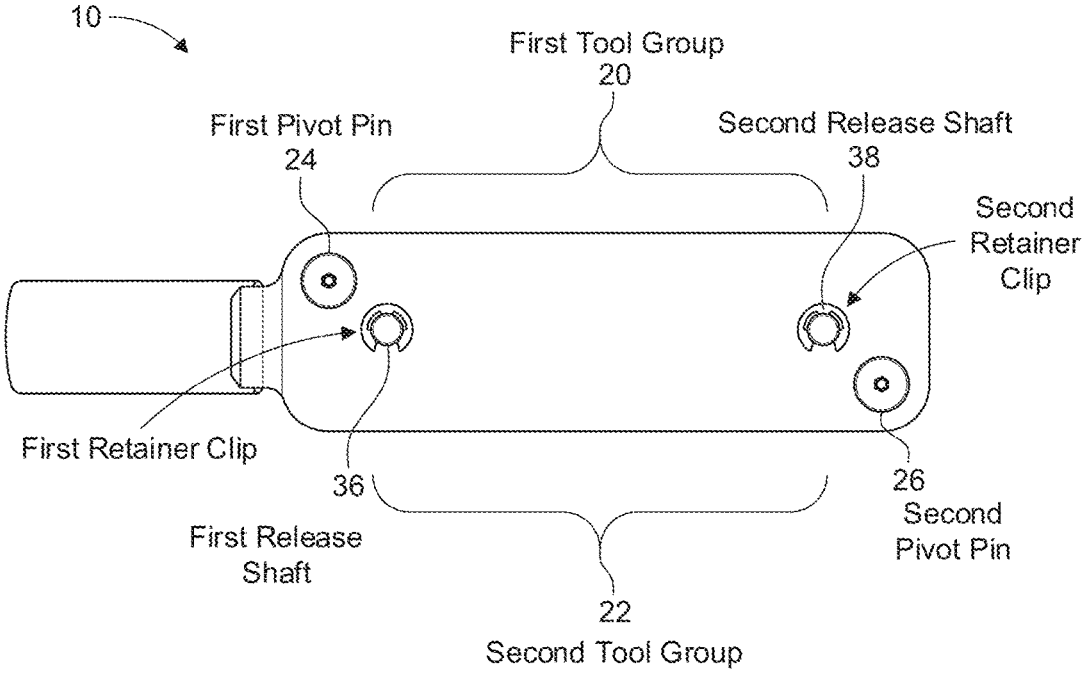
FIG. 8 is a second side view of the tool of FIG. 1.

FIG. 7 is a right side view of the tool 10 of FIG. 7, where the pivot pins 24, 26 and release buttons 32, 34 can be seen. FIG. 8 is a left side view of the tool 10 of FIG. 1, where the pivot pins 24, 26 and release shafts 36, 38 can be seen. The release shafts 36, 38 (which terminate in buttons [32, 34] at their opposite ends) are held within the frame 12 by retainer clips 40, 42. Now turning to FIG. 9, we can examine a final novel feature of the tool 10 of the present invention.

Figure 9:
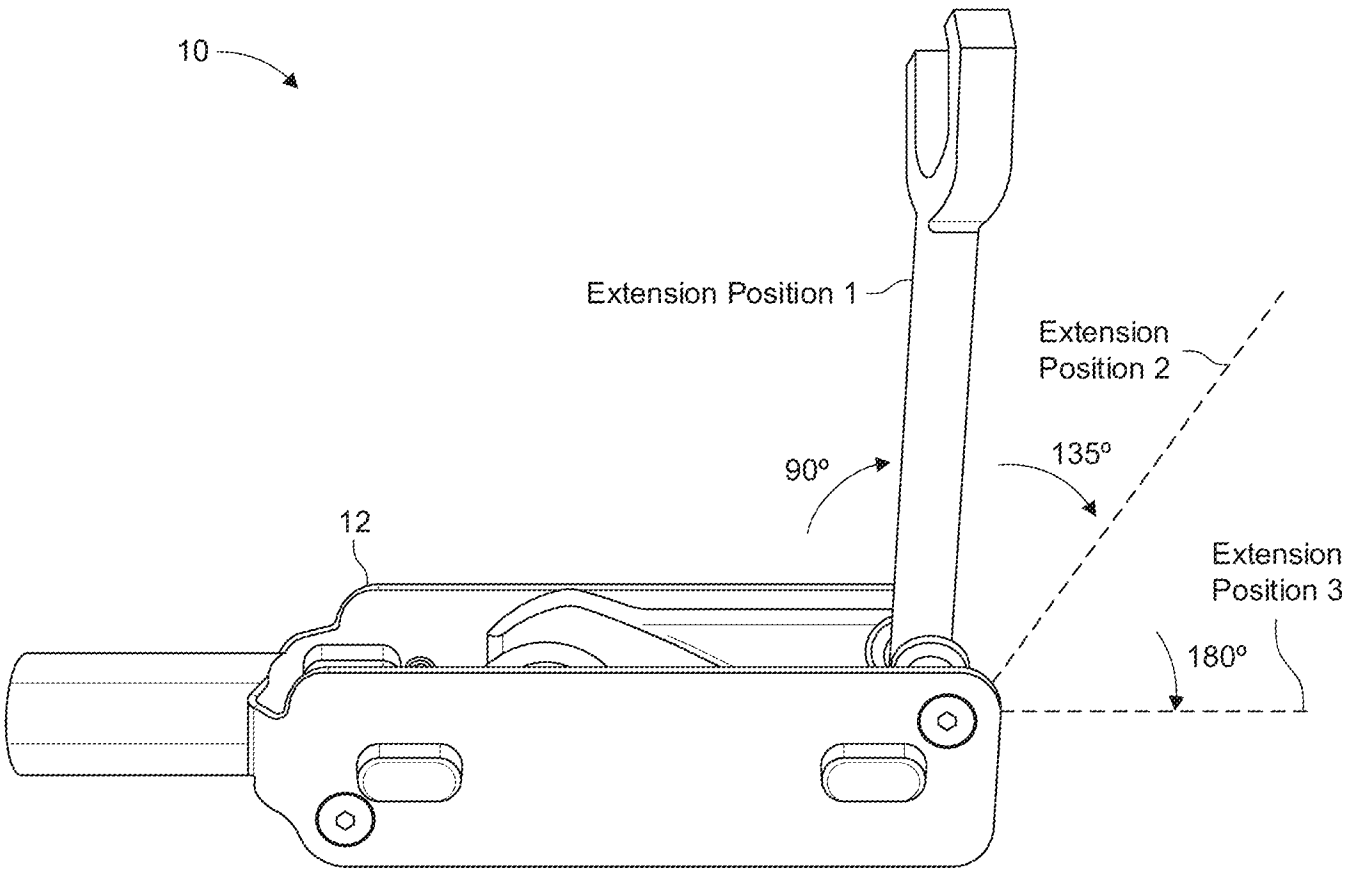
FIG. 9 is a side perspective view of the tool of FIG. 1.

FIG. 9 is a side perspective view of the tool 10 of FIG. 1. As discussed previously, there are a series of notches that are engaged by release shafts in order to retain each wrench in a variety of positions (plus their stowed positions within the outer frame 12). Here, the second spanner wrench 22B is depicted as being positionable in three different positions—Extension Position 1 is at 90 (ninety) degrees from the frame 12 axis; Extension Position 2 is at 135 (one hundred thirty five) degrees from the frame 12 axis; and Extension Position 3 is at 180 (one hundred eighty) degrees from the frame 12 axis. While other positions may be selected, it has been determined that these are ideal for most circumstances. These Extension Positions refer to the elements of the Second Group of Tools 22. The First Tool Group 20 will likely only have Extension Positions 1 and 2 (90 and 135 degrees).

Figure 10:
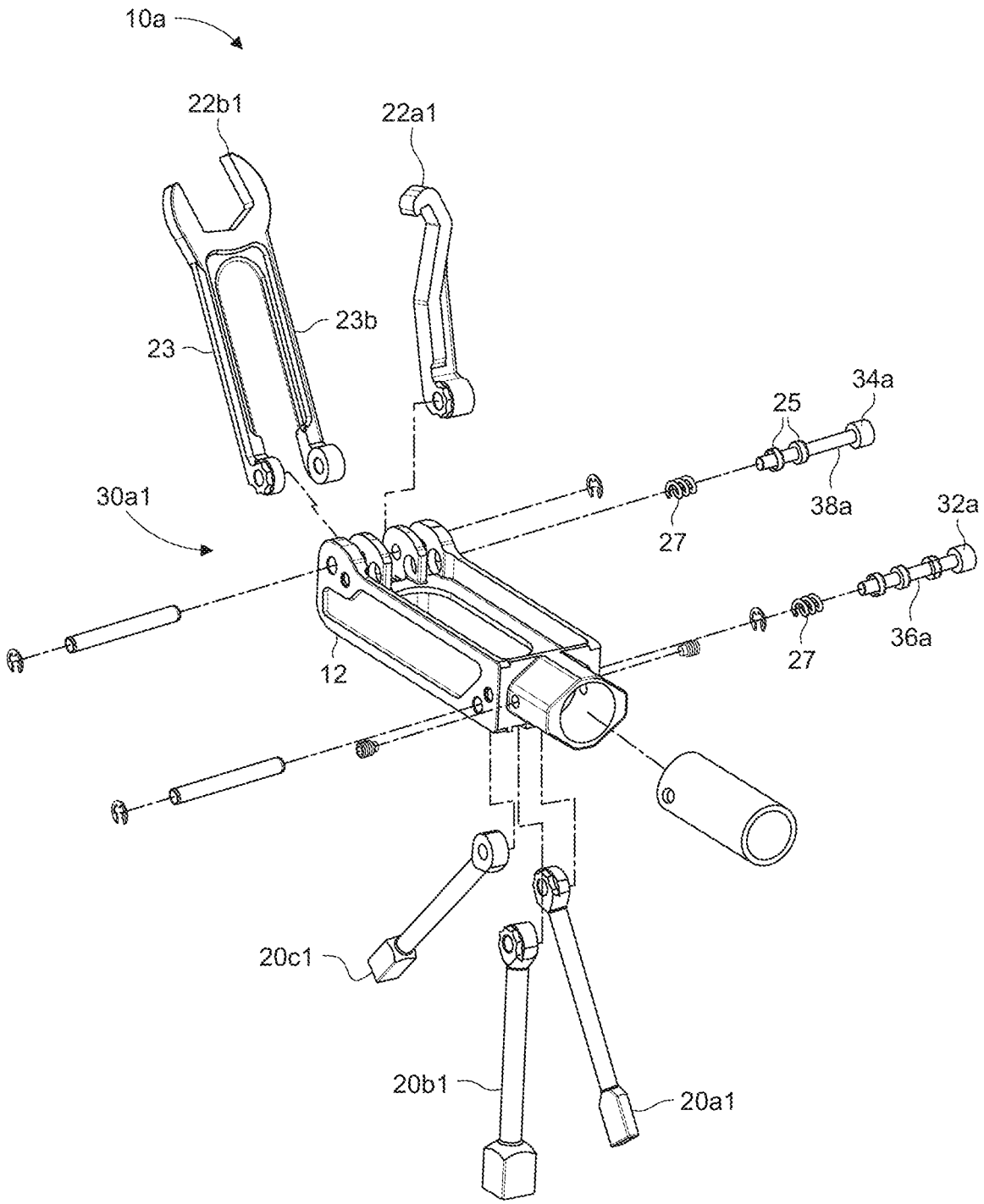
FIG. 10 is an exploded perspective view of an alternate embodiment of the shipboard multi-tool of the present invention.

FIG. 10 is an exploded perspective view of an alternate embodiment 10A of the shipboard multi-tool of the present invention. While substantially the same functionality as the prior embodiment of the tool 10, this version incorporates improvements largely related to improved manufacturability, and therefore lower cost. Specifically, only two spanner wrenches 22B1 and 22B2 are provided, rather than the three spanner wrenches provided in the original tool 10 version. As is further apparent, the second alternate spanner wrench 22B1 has a pair of "arms" 23A, 23B connecting it to the pivot points, rather than a single arm, as in the prior version 10. This allows the alternate first spanner wrench 22A1 to "nest" between the two arms 23A, 23B when the wrenches 22A1, 22B1 are stowed within the outer frame 12 (see FIGS. 11E, 11F).

Another improvement in the alternate version 10A is that the notched plates [30A, etc.] have been incorporated within the pivot end of each tool. These alternate notched plates (e.g. 30A1) are recessed notches formed around all or a portion of the circumference of the hubs of each tool. This improvement provides for the indexed rotation of each tool to a variety of discrete rotational positions, at which each tool is locked into place until the respective release button (32A, 34A) is depressed. Each notch of each notched plate (e.g. 30A1) is engageable by a corresponding locking ring 25 formed around the release shaft (e.g. 38A, 36B). The locked tool is then unlocked by depressing the release button (34A or 32A) such that the release shaft (36A, 38A) slides towards its respective biasing element 27 (i.e. compressing the biasing element 27). The unlocked tool can then be rotated until the release button (32A, 34A) is released and the corresponding locking ring 25 engages another one of said notches in the notched plate (e.g. 30A1).

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A multi-function tool assembly, comprising:

an outer frame, defined by a proximal end and a distal end, said out frame having an elongated frame axis;

a first pivot pin extending through said outer frame adjacent to said proximal end;

a second pivot pin extending through said outer frame adjacent to said distal end;

a first tool group, each member of said group pivotally attached to, and extending from said first pivot pin;

a second tool group, each member of said group pivotally attached to, and extending from said second pivot pin; and a hollow, non-foldably attached tubular element attached to the proximal end of the outer frame and extending longitudinally therefrom along the elongated frame axis, the tubular element combining with the outer frame to form a T-shape relative to a member of the first tool group pivotally attached to said first pivot pin adjacent to said proximal end for rotating the member of the first tool group, and combining with the outer frame to form a further extended length relative to a member of the second tool group pivotally attached to said second pivot pin adjacent to said distal end, the tubular element configured to accept an elongated handle therein to form an even further extended length, and the tubular element configured to fit over and receive a lever to be turned by applying rotational force to the tubular element via the outer frame.

2. The assembly of claim 1, wherein said first tool group comprises a first key wrench defined by an elongate stem terminating in a generally square-shaped distal end.

3. The assembly of claim 2, wherein said second tool group comprises a first spanner wrench defined by at least one elongate stem terminating in a first spanner wrench head.

4. The assembly of claim 3, wherein each said stem proximal end comprises a transverse bore and a plurality of notches formed therearound, and through which either said first or second pivot pin passes, such that each said tool is pivotable around said first or second pivot pin.

5. The assembly of claim 1, further comprising a first release shaft extending through said outer frame, said first release shaft comprising one or more locking rings protruding radially from said shaft such that one said locking ring is configured to engage one of said notches formed in one said tool and thereby prevent rotation of said tool.

6. The assembly of claim 5, wherein said first tool group comprises a small key wrench, a medium key wrench and a large key wrench.

7. The assembly of claim 6, wherein said second tool group comprises a first spanner wrench and a second spanner wrench.

8. A foldable tool assembly, comprising:

an outer frame, defined by a proximal end, a distal end, and an elongated frame axis, and a handle socket non-foldably attached to said proximal end of the outer frame and extending along the elongated frame axis from said proximal end of said outer frame, said handle socket comprising a hollow tubular element configured to accept an elongate handle therein;

a first pivot pin extending through said outer frame adjacent to said proximal end;

a second pivot pin extending through said outer frame adjacent to said distal end;

a first tool group, each member of said group pivotally attached to, and extending from said first pivot pin, the outer frame and handle socket forming a T-shape in combination with a member of the first tool group that is pivoted perpendicularly outward from the outer frame about the first pivot pen; and a second tool group, each member of said group pivotally attached to, and extending from said second pivot pin, the outer frame and handle socket forming an elongated assembly for rotating a member of the second tool group that is pivoted away from the outer frame about the second pivot pin.

9. The assembly of claim 8, wherein said first tool group comprises a first key wrench defined by an elongate stem terminating in a generally square-shaped distal end.

10. The assembly of claim 9, wherein said second tool group comprises a first spanner wrench defined by at least one elongate stem terminating in a first spanner wrench head.

11. The assembly of claim 10, wherein each said stem proximal end comprises a transverse bore and a plurality of notches formed therearound, and through which either mid first or second pivot pin passes, such that each said tool is pivotable around said first or second pivot pin.

12. The assembly of claim 11, further comprising a first release shaft extending through said outer frame, said first release shaft comprising one or more locking rings protruding radially from said shaft such that one said locking ring is configured to engage one of said notches formed in one said tool of said first tool group and thereby prevent rotation of said tool.

13. The assembly of claim 12, farther comprising a second release shaft extending through said outer frame, said first release shaft comprising one or more locking rings protruding radially from said shaft such that one said locking ring is configured to engage one of said notches formed in one said tool of said second tool group and thereby prevent rotation of said tool.

14. The assembly of claim 8, wherein said first tool group comprises a small key wrench, a medium key wrench and a large key wrench.

15. The assembly of claim 8, wherein said second tool group comprises a first spanner wrench and a second spanner wrench.

* * * * *